United States Patent [19]

Amendola

[11] 4,202,757

[45] May 13, 1980

[54] COAL LIQUIFICATION PROCESS

[75] Inventor: Steven C. Amendola, Scarsdale, N.Y.

[73] Assignee: Future Research, Inc., Yonkers, N.Y.

[21] Appl. No.: 924,799

[22] Filed: Jul. 14, 1978

[51] Int. Cl.[2] ..... C10G 1/06; C10G 13/02; C10J 3/00

[52] U.S. Cl. ..... 208/10; 208/112; 48/197 R; 48/210

[58] Field of Search ..... 208/10, 112; 48/210, 48/197 R

[56] References Cited

U.S. PATENT DOCUMENTS

| | | | |
|---|---|---|---|
| 2,119,647 | 6/1938 | Pier et al. | 208/10 |
| 2,966,450 | 12/1960 | Kimperlin et al. | 208/10 |
| 3,542,665 | 11/1970 | Wald | 208/10 |
| 3,700,583 | 10/1972 | Salamony et al. | 208/8 |
| 3,764,515 | 10/1973 | Kiovsky | 208/10 |
| 4,036,738 | 7/1977 | Wristers | 208/112 |
| 4,089,772 | 5/1978 | Gorfaty et al. | 208/8 R |
| 4,090,944 | 5/1978 | Moore et al. | 208/10 |
| 4,092,235 | 5/1978 | Schlosberg et al. | 208/10 X |

*Primary Examiner*—Delbert E. Gantz
*Assistant Examiner*—William G. Wright
*Attorney, Agent, or Firm*—Brumbaugh, Graves, Donohue & Raymond

[57] ABSTRACT

Essentially solid carbonaceous material such as coal is rapidly converted to a high percentage of liquid hydrocarbon products by first reacting said material with an acid to form carbon addition products which then are reacted with a Group V halide ion-acceptor system (super-acid system), the acid content of which is greater than the Group V halide content, and thereafter with a hydrogen donor source. All phases of the process may be carried out at atmospheric pressure and relatively low temperatures, thus making said process far more economical than known coal liquification processes.

21 Claims, 1 Drawing Figure

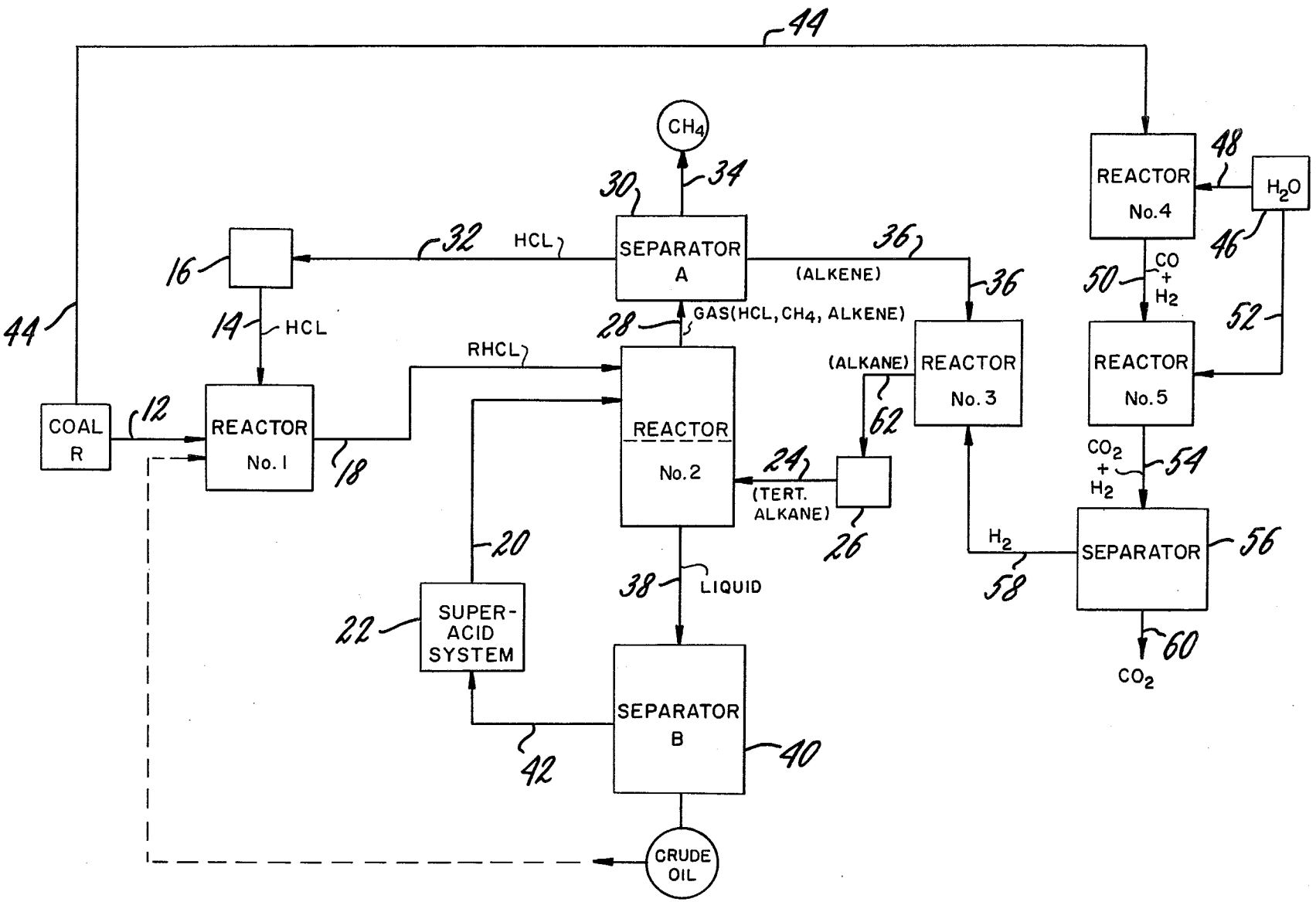
H2O
48
46
52
REACTOR No.4
CO + H2
50
REACTOR No.5
54
CO2 + H2
SEPARATOR
56
60
CO2
H2
58
REACTOR No.3
36
36
(ALKANE)
62
26
(ALKENE)
GAS(HCL, CH4, ALKENE)
24
(TERT. ALKANE)
44
CH4
34
SEPARATOR A
30
28
REACTOR No.2
LIQUID
38
SEPARATOR B
40
CRUDE OIL
HCL
32
RHCL
20
SUPER-ACID SYSTEM
22
42
18
16
HCL
14
REACTOR No.1
12
COAL R
44

COAL LIQUIFICATION PROCESS

BACKGROUND OF THE INVENTION

The vast reserves of coal in this country and throughout the world, have prompted and continue to prompt considerable interest and investigation into economical processes for the transformation of coal solids into liquid products that can be upgraded to provide synthetic petroleum fractions. The present invention provides such a process and is believed to represent a major break through in coal liquification technology, largely due to the fact that the process is designed to be carried out under normal atmospheric pressure.

The ability to convert coal to liquid hydrocarbon products is principally dependent upon the presence of relatively weak chemical bonds in the very large coal molecules which when thermally or catalytically cracked yield carbon free radicals. If hydrogen is available to react with the free radicals, desirable lower molecular weight hydrocarbons are produced.

Most, if not all, prior art coal liquification processes involve high-pressure systems. Even in those processes nominally referred to as "low pressure", the required pressure in one or more phases of the operation is anywhere from 20 to 90 atmospheres (300–1350 p.s.i.). Moreover, the prior art coal liquification (hydrogenation) processes generally all require relatively high temperatures (460° to 750° C.). The expense and engineering difficulties of operating at high temperatures and hydrogen pressures of 300–4000 p.s.i. and higher, result in such high production costs that the products are not commercially competitive with those produced from crude oil.

While conventional catalyst systems are generally employed to selectively accelerate the desired reactions essential to coal liquification processes, rapid deactivation of the ctalysts often result from the high hetroatom content of the coal, and the presence of polynuclear aromatic structures. Moreover, hydrogen sulfide, formed from the sulfur in coal, and ammonia formed from nitrogen, and oxygen deactivate acid cracking catalysts.

Accordingly, although it is known that hydrogenation and cracking of coal will produce a synthetic petroleum liquid product, difficulties such as those enumerated above have prevented realization of commercially efficacious processes for the conversion of coal to useful liquid fuels.

SUMMARY OF INVENTION

The present invention provides a novel process for rapidly converting coal as well as other fossil fuel sources such as oil shale or tar sands to valuable liquid hydrocarbon products. These products may be formed in accordance with the process in amounts ranging from 35% to 98% depending on the type of coal used and the temperature at which the process is run. Gas formation depends largely on the same variables and may range anywhere from 2% to 65%. (Should the process be run at temperatures of about 500° C. or higher, the process would be a coal gasification process since the gas yield would be substantially greater than the liquid yield.) The process is designed to operate with a low energy input, relatively low temperatures and atmospheric pressure, and thus, is far more economical than processes presently known and used in synthetic petroleum technology.

DETAILED DESCRIPTION OF INVENTION

The present process initially entails reacting pulverized coal with acids, such as hydrogen halides, hydrogen pseudohalides and sulphonates in accordance with the following reaction scheme:

$$R + HX \xrightarrow[\text{(heat)}]{\text{(solvents)}} \text{RHX}; \quad (1)$$

wherein R represents unsaturated bonds in the coal and HX is the general formula of the particular acid used. A critical parameter in choosing a suitable acid (HX) is that the acid molecules must be capable of donating a negative ligand to a strong Lewis acid in order to form carbonium ions. [See reaction (9) and related discussion, supra.] Suitable acids for the initial phase of the coal liquification process include hydrogen chloride, chlorosulphonic acid, hydrogen fluoride, flourosulphonic acid, hydrogen bromide, hydrogen iodide, sulphuric acid. Combinations of such acids are also contemplated for use in the initial reaction.

Hydrogen chloride and hydrogen fluoride are the preferred acids for use in the first phase of the process. It should be recognized, however that these acids, or any other acids used, need not be in their pure form and gaseous forms thereof may simply be passed over the coal (R) to form carbon addition products, e.g., RHCl or RHF. It is also possible to obtain the preferred acids by adding sulphuric acid and the sodium, potassium or calcium halide to the pulverized coal. Under these conditions the HF or HCl will be generated in situ:

$$2\text{NaCl} + \text{H}_2\text{SO}_4 + 2\text{R} \xrightarrow[\text{solvents)}]{\text{(heat/catalysts}} \text{Na}_2\text{SO}_4 + 2\text{RHCl}. \quad (2)$$

The phase one addition reaction, in either of the preferred systems, may be effectively catalyzed by the presence of an iron-copper catalyst. Moreover, the use of moisture and ash free coal is not necessary since the heat of the reaction and sulphuric acid (if used) will drive off any mositure in the coal and the use or formation of HF or HCl will demineralize the coal and thereby substantially eliminate the ash forming compounds.

In carrying out the initial phase of the process it is generally desireable to form a slurry by suspending the coal particles in any suitable liquid that aids the addition reaction of the acid and/or aids in the solvolysis or depolymerization of the coal. Liquids useful for these purposes include anthracene oil, para-toluenesulphonic acid, pyridene, xylene, hydronapthalenes and hydroathracenes. The use of anthracene oil is preferred, since it will be readily available from the products of the present process. Furthermore, the addition of small amounts (less than 5% by weight of the coal) of para-toluenesulphonic acid is also preferred for its coal depolymerization action. Additional compounds that may be added to aid the reaction in the first phase of the process include, ammonium bifluoride ($NH_4HF_2$) which aids the solvent reaction and trace amounts of antimony pentafloride ($SbF_5$), to help catalyze the addition reaction.

Accordingly, on reacting pulverized coal with hydrogen chloride, hydrocarbon addition products are essentially formed as indicated by the following chemical equation:

$$R-C{=}C-R + HX \longrightarrow R-\overset{H}{\overset{|}{C}}-\overset{X}{\overset{|}{C}}-R. \quad (3)$$

It is apparent that the reaction product is partially hydrogenated. In the second phase of the process, "X", the halogen group, is replaced by a hydrogen thus completing the hydrogenation process. While cracking is not a major aspect of the initial reaction, it nonetheless occurs and is desirable to the extent that the final petroleum compounds are of a lower molecular weight. Depolymerization is desirable at this stage of the process and para-toluenesulphonic acid in small quantities (<5%) is both inexpensive and readily available. Finally, while the initial reaction may be carried out at room temperature, the reaction is appreciably accelerated and more economical when carried out at an elevated temperature, i.e. approximately 300°-400° C.

In the second phase of the process, the RHCl (slurry) is first reacted with a Lewis acid, halide-ion-acceptor system, a.k.a. super-acid system, e.g. antimony pentafluoride in hydrogen fluoride. Group V halides are preferred for use in said system and include, inter alia, antimony pentachloride, antimony pentafluoride, bismuth pentafluoride, arsenic pentafluoride, phosphorous pentafluoride and phosphorous pentachloride. The bromides and iodides of the Group V elements are not as efficient as the above in their Lewis acid properties and not all of them are known to exist in the pentavalent state. Chemical compounds wherein there are some fluorines and chlorines on the same atoms are also suitable, e.g. $SbCl_2F_3$ or $SbCl_3F_2$. A general formula for the suitable Group V halide compounds is:

$$MX_nY_m, \quad (4)$$

wherein M is the Group V atom in the +5 oxidation state and X and Y are halogens which can be the same ($SbF_5$) or different ($SbClF_4$) and the sum of n and m equal 5. As a further criterion, the compound must have sufficient Lewis acidity to effect the following reaction:

$$MX_nY_m + RHX \longrightarrow \underset{\text{(carbonium ion)}}{[RH]^+} + [MX_{n+1}Y_m]^- \quad (5)$$

Suitable acids for use in the super-acid system include hydrogen fluoride, hydrogen chloride, chlorosulphonic acid and fluorosulphonic acid. The equivalent bromo and iodo acids are also suitable, although not preferred due to their lower reactivities and the undesirable problem of oxidizing the bromide and iodide ions to their element state. While many effective super-acid systems will be apparent to those skilled in the art, representative systems include combinations of the acids such as HF and $HSO_3F$ with $SbF_5$. The metal pentahalides can also be combined, for instance $SbF_5$ and $BiF_5$ (thus trinary, quaternary or even higher orders of systems are feasible). Other systems may include halide ion-acceptors such as pentaphenylbismuth $(C_6H_5)_5Bi$ or phenyl tetrachloroantimony $C_6H_5SbCl_4$. Furthermore, super-acid systems may be solid rather than liquid, such as $SbF_5$ with $TiO_2$ (titanium dioxide) or $SbF_5$ with $SiO_2$ (silicon dioxide).

In the context of the present coal liquification process, the Group V halides function essentially as Lewis acids, however they may also act as catalysts for the hydrogenation reaction. As generally acknowledged in the prior art, the use of metal halides as catalysts, requires pressures and temperatures substantially higher than those employed in the present process. Thus the fact that pressures of one or two orders of magnitude higher are necessary for catalytic operation indicates that the present process, at atmospheric pressure, is altogether different.

It is important to the successful operation of the present process that the acid content of the super-acid system be greater (as measured by mole/percent) that the Group V halide content. The amount of acid in the super-acid system should not be below about 50% and may go as high as 99%. The preferred range is where the acid is from 85% to 95% of the acid/Group V halide mixture.

The Group V halide component of the super-acid system does not generally experience any of the significant contamination problems associated with metal halide catalysts in prior art processes. Should moisture (water) react with any Group V chloride or floride the corresponding oxide or oxyhalide would be formed, e.g.:

$$2SbCl_5 + 5H_2O \rightleftharpoons Sb_2O_5 + 10HCl \quad (6)$$

$$SbCl_5 + H_2O \rightleftharpoons SbOCl_3 + 2HCl. \quad (7)$$

In either case, the product, although not helpful to hydrogenation, is not deactivating. If the first phase of the process is carried out at a temperature of about 100° C. or higher, or in the presence of sulphuric acid then it is unlikely that any water will be available to react with the Group V halide. However, in the event that some residual moisture does react with the Group V halide to form the oxide or oxyhalide, it would have to be separated. Fortunately the separation used for ash removal also removes these products. Moreover, since the reactions are reversible, with heat favoring the formation of the reactants ($SbCl_5$), if the second phase reactions are carried out at a temperature of about 100° C., the formation of oxides, etc. should be negligible. Hydrogen sulphide also forms the same type products:

$$2SbCl_5 + 5H_2S \rightleftharpoons Sb_2S_5 + 10HCl \quad (8)$$

However this reaction barely proceeds at all since HCl is a stronger acid and would tend to form the $SbCl_5$.

The atmosphere in which the second phase of the reaction process takes place is preferrably one of hydrogen, albeit, at normal pressure. But the atmosphere will also contain the gaseous products of the reaction which of course will be separated and used accordingly.

Due to the high reactivity of the medium many conventional catalysts cannot be used. However any catalysts which aid hydrogenation and are inert towards the super-acid system may be used.

Other compounds which aid the second phase reactions include small amounts of polymerization inhibitors such as hydroquinone or other oxidation inhibitors. These compounds prevent the reaction products from polymerizing to heavier fractions.

As a result of the reaction of RHCl with the super-acid system, carbonium ions are formed which when reacted with a hydrogen donor source yield commercially valuable, liquified, hydrogenated products. These products can, thereafter, be separated by conventionally known techniques from any remaining solids as well as from the components of the super-acid system, both of which can be recycled to make the process continuous.

The reactions in the second phase of the novel process are believed to proceed in accordance with the following reaction scheme:

$$RHX+2SbX_5+2HX \rightarrow RH^+ + 2SbX_6^- + H_2X^+ \quad (9)$$

$$RH^+ + R^1H \rightarrow RH_2 + R^1 \quad (10)$$

$$2SbX_6^- + 2H_2X^+ \rightarrow 4HX + 2SbX_5 \quad (11)$$

Any suitable hydrogen donor source may be used. The concept of a hydrogen donor is that in a suitable medium a saturated hydrocarbon will react to give some of its hydrogen to unsaturated compounds. However the ability to lose hydrogen decreases with increasing molecular size. Therefore, this reaction favors exchange of hydrogen from low molecular weight saturated compounds to high molecular weight unsaturated compounds.

Compounds that contain tertiary carbons are the most reactive and hence preferred hydrogen donor sources. These compounds are readily available if during or after the hydrogenation process in Reactor No. 3 (FIG. 1) the gases are passed through systems containing either $AlX_3+HX_b$ or $BX_3+HX_b$, wherein X is the same or different and selected from F, Cl, Br or I. The presence of copper aids these reactions, which are known as rearrangements, and trace amounts of water or oxygen are also required:

$$C-C-C-C \xrightarrow{AlF_3 + HF} C-\overset{\overset{C}{|}}{C}-C. \quad (12)$$

It should be noted that this reaction does not interfere with hydrogenation.

Highly reactive branched alkanes and particularly those which have a low boiling point serve as a preferred source of hydrogen. These alkanes range from ethane to hexanes and higher; however, a factor militating against compounds having long carbon chains being that it is often difficult to rehydrogenate such compounds. Branched alkanes will be readily available from the alkene reaction products generated in the present process, which can be recycled through hydrogenation (and rearrangement) to provide a continuous hydrogen donor source.

In order for the hydrogenation of the alkenes to proceed at a reasonable rate at atmospheric pressure, two important factors must be maintained; first, the alkenes must have a chain length of no more than six (6) carbon atoms, and must be cleansed of catalytic poisons such as $H_2S$, before passing to Reactor No. 3 (FIG. 1); and second, a catalyst must be used having a highly reactive, high surface area. The vapor deposition of nickel (raney nickel) onto a high surface area support, e.g. molecular sieves, sintered glass, activated charcoal, provides a preferred catalyst system, and one capable of hydrogenating the alkenes to alkanes at atmospheric pressure and with residence times on the order of one second or less.

The addition reaction between the acid (HX) and the coal in Reactor No. 1 [FIG. 1] is the slowest reaction in the process; it is also the least critical and hence many impurities may be present without adverse effects. Residence time in the first reactor should be around five (5) minutes provided that temperatures are maintained within the preferred range of 390° C. to 400° C. and a suitable solvent/catalyst system is employed. The residence time in the second reactor should be no more than about one (1) minute. Accordingly, for dynamic flow the amount of material reacted in Reactor No. 1 should be at least five (5) times that in Reactor No. 2. The exact figures, however, should be based on the actual commercial conditions.

The residence time in Reactor No. 3 is about one second or less, and therefore should present no problems in the recycling of the alkenes to form alkanes fast enough for use in Reactor No. 2. Moreover, an excess of hydrogen donors in Reactor No. 2 is not only harmless but beneficial as it favors the hydrogenating equilibrum.

While the conversion percentage in Reactor No. 1 could approach 100%, in practice it is unlikely since this reaction is the most difficult. Nevertheless, yields are still quite high and range between about 80–90%. The coal that does not react will simply come out with the liquified product and can be separated and returned to Reactor No. 1.

The total reaction scheme is as follows:

Coal=R
Coal+HX=RHX
Hydrogen Donor=$R'H_2$
Dehydrogenated Hydrogen Donor=R'
Desired Liquid Products=$RH_2$ Net Equations Reactor No. 1

$$R + HX \xrightarrow[5\text{ mins.}]{\text{solvents, catalysts } 390°\text{–}400°\text{ C.}} RHX \quad (13)$$

(HX: excess acid)

Reactor No. 2

$$RHX + R'H_2 \xrightarrow[\text{catalysts, 1 min. } H_2\text{ atm.}]{MX_5 + HX + HSO_3X\ 150°\text{ C.–}200°\text{ C.}} RH_2 + R' + HX \quad (14)$$

($R'H_2$: excess donor; (excess acid): HX, $HSO_3X$)

(HX returned to Reactor No. 1; R' returned to Reactor No. 3 and $RH_2$ is drawn and cleaned conventionally)

Reactor No. 3

$$R' + H_2 \xrightarrow[150°\text{ C., 1 sec.}]{\text{Ni (cat.) Rearrangement cat.}} R'H_2 \quad (15)$$

($R'H_2$ returned to Reactor No. 2)

If it is desired to produce more gaseous products, the reactions in Reactor Nos. 1 and 2 should be run at 500° C. or higher. The major problem, however, is that it becomes necessary to limit the super-acid system to ones that do not readily decompose at such temperatures.

Where the reactions are run primarily for liquification at the lower temperatures (300°–400° C. in the first phase, and 150° to 200° C. in the second phase), gas is still produced. The gas is largely of the natural gas type, having a high BTU (heating value) and which makes it economical for transportation through already existing pipeline systems. The liquid products would also be suitable for pipeline transport.

The process of the present invention may vary depending on the type of coal that is used. The critical properties of coal that will cause variations in the process are: carbon percentage, hydrogen percentage, caking quality, heating value (energy content), moisture, ash content and rank.

While economics and geography may impose limits on which coals are available for use, all four classes of coals (lignites, bituminous, carbonaceous and anthracites) can be used in this process. Furthermore, the sulphur content of the coal used in the process is not particularly relevant, since the final product generally averages less than 0.2% sulphur. The reason being that the process hydrogenates sulphur at the —C—S—C (sulphur bridges) and C-SH (mercaptans) bonds to $H_2S$ (hydrogen sulphide) gas which comes off and may be separated from other gases.

It is desirable that the final product have a high hydrogen percentage, since liquids having a higher energy content are more valuable compounds. Accordingly, it is possible to recycle the liquid product through the process and obtain such higher hydrogen percentages. Nevertheless, almost any liquid product is suitable for pipeline transport and can be used in conventional refineries to obtain the desired products, just as crude oil is used.

Another important parameter of the process is the partical size of the coal. If pulverized coal particles having about 44 microns are used, reactivities are increased due to the increase in coal surface area. While it may be expensive to crush coal to such small sizes, the savings in smaller plant size/unit and increased output due to faster reaction times should amply offset the costs of crushing the coal. Any compounds such as surfactants, present in the coal, in quantities as low as 0.1% that increase grinding efficiently and decrease the energy used are helpful. Alkylenesulphonates and alkanesulphonates are good surfactants for the grinding operation and can also reduce the energy required to grind coal by about 20% while improving output by 30%.

All phases of the present process are carried out at normal pressure. The temperature of the reaction for the formation of the carbonium ion and its subsequent hydrogenation is preferably equal to the boiling point of the acid used in the super-acid system. Moreover, as is apparent from the above, the process of this invention may be operated either in batch or continuous manner and preferably is operated continuously for the usual reasons of high production rates and higher efficiency and thus overall economy.

DESCRIPTION OF DRAWING

The accompanying drawing illustrates a flow diagram representing one embodiment of the process of this invention. Since the drawing is highly schematic, it does not illustrate heaters, pumps, valves, instrumentation and other conventional equipment that would normally be employed in such a process.

DESCRIPTION OF PREFERRED EMBODIMENT

In the drawing, pulverized coal (R) is supplied to Reactor No. 1, and contacted therein with hydrogen chloride, supplied from vessel 16 through line 14, and anthracene oil from a source not shown. The slurry mixture formed is heated to a temperature of about 390° C. to accelerate the formation of carbon addition products (RHCl). The hydrogen chloride used in Reactor 1 may be recycled from the process as herein described. The slurry and carbon addition products once formed, are then pumped through line 18 to a second reaction chamber, Reactor No. 2.

A Lewis acid, halide-ion-acceptor system (super-acid system), in this case a mixture of chlorosulphonic acid and antimony pentachloride (85% acid and 15% metal halide), is introduced into Reactor No. 2 through line 20 from vessel 22. Thereafter a hydrogen donor source, in this instance a highly reactive, low boiling point branched alkane (containing no more than six (6) carbon atoms) is introduced into Reactor No. 2 from vessel 26 through line 24. Both the super-acid system and the branched alkane can be recycled from the process as described herein.

The reaction in Reactor No. 1, i.e., the formation of the addition products designated RHCl, takes place in an air environment at one atmosphere and at a temperature of about 390° C. The reaction of the carbon addition products (RHCl) and the super-acid system and the subsequent hydrogenation with the branched alkane in Reactor No. 2 also occurs at one atmosphere, but at a lower temperature—equal to the boiling point of the acid, i.e. the chlorosulphonic acid of the super-acid system. As noted earlier, the use of a hydrogen atmosphere is preferred in Reactor No. 2.

Gaseous reaction products produced, as a result of the reactions in Reactor No. 2 pass through line 28 to a separator 30 wherein hydrogen chloride, methane and alkenes are separated. Hydrogen chloride is passed through line 32 to vessel 16 for reuse in Reactor No. 1; methane is recovered through line 34 and the alkenes are decontaminated and passed through line 36 to Reactor No. 3 wherein they are hydrogenated to alkanes.

The liquified, hydrogenated products along with unreacted solids and other reaction products produced in accordance with the various reactions in Reactor No. 2 are transferred through line 38 to vessel 40 for distillation and separation. The Group V halide, antimony pentachloride and chlorosulfonic acid, recovered from vessel 40, are passed through line 42 to vessel 22 for reuse in Reactor No. 2.

To provide hydrogen for the hydrogenation of the alkenes delivered to Reactor No. 3, a portion of the pulverized coal (R) is supplied to Reactor No. 4 through line 44 where it is mixed with water, supplied from vessel 46 through line 48 and heated to form carbon monoxide and hydrogen gas. Said gases pass through line 50 to Reactor No. 5, wherein said gases are again mixed with water, supplied through line 52, and heated to yield carbon dioxide and hydrogen. These gases are in turn passed through line 54 to separator 56 wherein hydrogen is separated from the carbon dioxide and passed through line 58 to Reactor No. 3. The carbon dioxide is passed from the separator 56 through line 60.

The highly reactive alkenes which are supplied from separator 30 through line 36 to Reactor No. 3 are hydrogenated at atmospheric pressure and at an extremely high rate over a suitable catalyst such as nickel, present, but not shown, in Reactor No. 3. The alkane derived from Reactor No. 3 is passed through line 62 to vessel 26 for reuse in Reactor No. 2. Vessel 26 may optionally be adapted to provide for a subsequent rearrangement reaction as discussed earlier.

The process of the present invention may be varied in the manner of its performance without departing from the scope or spirit of the invention. For example, any Lewis-acid system strong enough to accept the halide ion from the coal structure is suitable. Moreover, any method which effects hydrohalogenation in Reactor No. 1 may be suitable. It should be noted that the use of just chlorine or florine in Reactor No. 1 may yield a liquid product at the end of the process, due to depolymerization; however, since halogens react by substitution

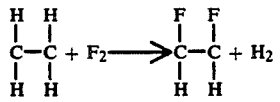

(16)

and not addition, it is not possible to increase the percent of hydrogen if the halogens are used. So even though they tend to be more reactive than the hydrogen halides the use of hydrogen halides is essential if hydrogenation is desired. Finally, those skilled in the art will appreciate that while the present process is designed to function economically at atmospheric pressure, elevated pressure conditions may also be conventionally utilized. Accordingly, it is to be understood that the use of such higher pressures in conjunction with the foregoing process is within the scope of the present invention. The use of lower pressures in conjunction with the forgoing process is also within the scope of the present invention.

I claim:

1. A process for rapidly converting essentially solid carbonaceous material to essentially liquid and gaseous hydrocarbon products, comprising a first phase of reacting said solid material with at least one acid to form carbon addition products, and a second phase of reacting products of the first-phase reaction with a Lewis acid, halide-ion-acceptor (super-acid) system and hydrogen donor source (hydrogenation), and wherein the acid or acid combinations used in the first phase is capable of donating a negative ligand to the Lewis acid in the second phase in order to form carbonium ions.

2. A process according to claim 1, wherein all reactions are conducted at normal (atmospheric) pressure conditions.

3. A process according to claim 1, wherein the carbonaceous material is coal, or another fossil fuel source.

4. A process according to claim 1 wherein the reaction in the first phase is hydrohalogenation reaction.

5. A process according to claim 1 wherein the carbonaceous material is coal, pulverized to an extent sufficient to increase the surface area thereof in order to accelerate the first phase reaction.

6. A process according to claim 1, wherein the first phase reaction is run at a temperature of between about 390° C. to 400° C.

7. A process according to claim 1 wherein the super-acid system comprises antimony pentachloride and chlorosulphonic acid, or antimony pentafluoride, bismuth pentafluoride and fluorosulphonic acid.

8. A process according to claim 1 wherein the hydrogen donor source is branched, or cyclic alkane having a boiling point of about below 50° C.

9. A process according to claim 1 wherein the second phase reactions are run in a hydrogen atmosphere at normal pressure.

10. A process according to claim 1, wherein the second phase reactions are run at temperatures ranging between about 150° C. to about 200° C.

11. A process according to claim 1, wherein said process is made continuous through the recycling of the reagents used in the reactions in the first and second phases of the process.

12. A process wherein a liquid hydrocarbon material is treated in accordance with the procedure of claim 1.

13. A process comprising the steps according to claim 1, and wherein the reactions in the first and second phases are run at temperatures of at least about 500° C.

14. A process according to claim 4 wherein the acid used to effect the hydrohalogenation reaction is hydrogen fluoride or hydrogen chloride.

15. A process according to claim 14 wherein the hydrogen fluoride or hydrogen chloride is derived in situ through the addition of sulphuric acid and the sodium, potassium or calcium halide.

16. A process according to claim 5 wherein a slurry is formed in the first phase by suspending the coal particles in a suitable liquid system that aids in solvolysis and depolymerization of the coal.

17. A process according to claim 16 wherein the liquid system comprises, anthracene oil, an iron-copper catalyst and 5% or less, by weight of the coal, of paratoluenesulphonic acid.

18. A super-acid system utilized in the second phase of the process according to claim 1, comprising at least one Group V halide and at least one suitable acid and wherein the Group V halide has the general formula $MX_nY_m$, M being the Group V atom and X and Y being halogens which may be the same or different and the sum of n and m equaling five (5).

19. A super-acid system according to claim 18 wherein the acid content is greater, as measured by mole/percent, than the Group V halide content.

20. A process according to claim 7, wherein 15% antimony pentachloride is combined with 85% chlorosulphonic acid; and where 12% antimony pentafluoride is combined with 3% bismuth pentafluoride and 85% fluorosulphonic acid.

21. A process according to claim 11, wherein the hydrogen donor source is branched alkane, which is converted to an alkene upon completion of the hydrogenation reaction in the second phase of the process, and thereafter is subjected to hydrogenation and rearrangement reactions to yield a branched alkane for continued use as a hydrogen donor.

* * * * *

UNITED STATES PATENT AND TRADEMARK OFFICE

CERTIFICATE OF CORRECTION

PATENT NO. : 4,202,757

DATED : May 13, 1980

INVENTOR(S) : Steven C. Amendola

It is certified that error appears in the above-identified patent and that said Letters Patent are hereby corrected as shown below:

Col. 4, line 27, between equations (6) and (7) insert --or--;

Col. 6, line 45, "$RH_2$+R'+HX" should appear directly after the horizontal arrow in line 41.

Signed and Sealed this

Second Day of September 198(

[SEAL]

Attest:

SIDNEY A. DIAMOND

Attesting Officer

Commissioner of Patents and Trademarks